US011583709B2

(12) United States Patent
Chi

(10) Patent No.: US 11,583,709 B2
(45) Date of Patent: Feb. 21, 2023

(54) FACE MASK

(71) Applicant: Chih-Pao Chi, Taichung (TW)

(72) Inventor: Chih-Pao Chi, Taichung (TW)

(73) Assignee: YOND HOME CHANT ENTERPRISE CO., LTD., Taichung (TW)

( * ) Notice: Subject to any disclaimer, the term of this patent is extended or adjusted under 35 U.S.C. 154(b) by 236 days.

(21) Appl. No.: 17/125,957

(22) Filed: Dec. 17, 2020

(65) Prior Publication Data

US 2022/0072343 A1 Mar. 10, 2022

(30) Foreign Application Priority Data

Sep. 8, 2020 (TW) ..... 109211739

(51) Int. Cl.

| | |
|---|---|
| ***A62B 18/02*** | (2006.01) |
| ***A62B 7/10*** | (2006.01) |
| ***A62B 7/12*** | (2006.01) |
| ***A62B 18/08*** | (2006.01) |
| ***A62B 23/02*** | (2006.01) |
| ***A41D 13/11*** | (2006.01) |

(52) U.S. Cl.

CPC ..... *A62B 18/02* (2013.01); *A41D 13/1107* (2013.01); *A62B 7/10* (2013.01); *A62B 7/12* (2013.01); *A62B 18/084* (2013.01); *A62B 23/02* (2013.01); *A41D 13/1138* (2013.01); *A41D 13/1161* (2013.01)

(58) Field of Classification Search

CPC ..... A62B 18/08; A62B 18/084; A62B 7/00; A62B 7/10; A62B 9/00; A62B 9/04; A62B 17/00; A62B 17/17006; A62B 18/00; A62B 18/02–025; A62B 18/088; A62B 19/00–02; A62B 23/00–02; A41D 13/11–1107; A41D 13/1138–1146; A41D 13/1161–1176; A41D 13/1192; B63C 2011/165; B63C 11/16

See application file for complete search history.

(56) References Cited

U.S. PATENT DOCUMENTS

| | | | | |
|---|---|---|---|---|
| 2003/0136410 | A1* | 7/2003 | Matich | A62B 18/08 128/206.25 |
| 2004/0040561 | A1* | 3/2004 | Tayebi | A62B 23/025 128/205.27 |
| 2004/0226563 | A1* | 11/2004 | Xu | A62B 18/02 128/206.23 |
| 2008/0245364 | A1* | 10/2008 | Patterson | A62B 7/10 128/201.28 |
| 2016/0030779 | A1* | 2/2016 | Twu | A62B 18/02 128/202.13 |
| 2020/0130792 | A1* | 4/2020 | Huang | B63C 11/16 |

FOREIGN PATENT DOCUMENTS

DE 102015107175 A1 * 11/2016

* cited by examiner

*Primary Examiner* — Daniel J Colilla

(57) ABSTRACT

A face mask includes a space formed therein by a peripheral wall extending from the periphery of the space. At least one first path and at least one second path are respectively formed in the space so that outside air enters into the space via the at least one first pat, and air in the space is released from the space via the at least one second path. The face mask covers a large area of the wearer's face to reduce foreign objects from entering into the wear's body so as to reduce the chance of being infected.

5 Claims, 14 Drawing Sheets

FACE MASK

BACKGROUND OF THE INVENTION

1. Fields of the Invention

The present invention relates to a face mask, and more particularly, to a face mask that stop being infection by respiratory droplets, virus or germs.

2. Descriptions of Related Art

Population and intense interaction in cities are increased rapidly, and virus and germs are thought to spread mainly through close contact from person to person, including between people who are physically near each other. Respiratory droplets cause infection when they are inhaled or deposited on mucous membranes, such as those that line the inside of the nose and mouth. Therefore, many people wear face masks to reduce the possibility of infection.

Taiwanese Utility No. M598155 discloses a mask which includes a first rope, a second rope and a filtering portion. The first and second ropes are used to hook on the wearer's ears so that the filtering portion covers the wearer's nose and mouth so as to reduce the risk of being infected.

However, the mask cannot cover up the wearer's eyes, and the sink around nose and mouth. These portions are exposed to the dust, virus and germs. Therefore, how to provide a larger protection area of the user's face is an important issue for the mask manufacturers.

The present invention intends to provide a face mask to eliminate shortcomings mentioned above.

SUMMARY OF THE INVENTION

The present invention relates to a face mask and comprises a space formed in the face mask by a peripheral wall extending from the periphery of the space. At least one first path and at least one second path are formed in the space so that outside air enters into the space via the at least one first pat, and air in the space is released from the space via the at least one second path.

The primary object of the present invention is to provide a face mask that covers up the skin around the wearer's mouth, nose and eyes so as to keep the wearer's face skin from contacting the droplets, germs and virus outside the face mask.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
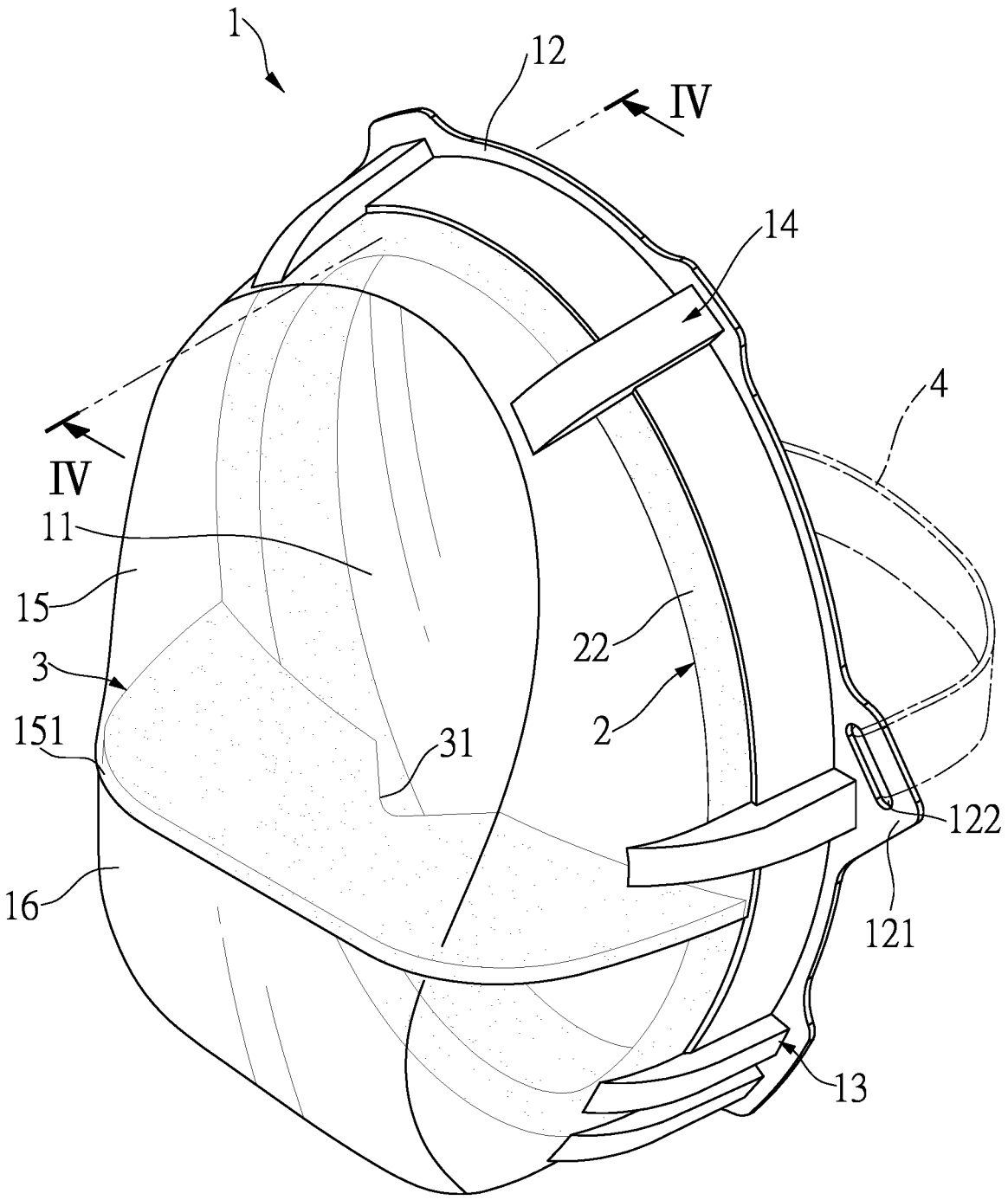
FIG. 1 is a perspective view to show the face mask of the present invention.
Figure 2:
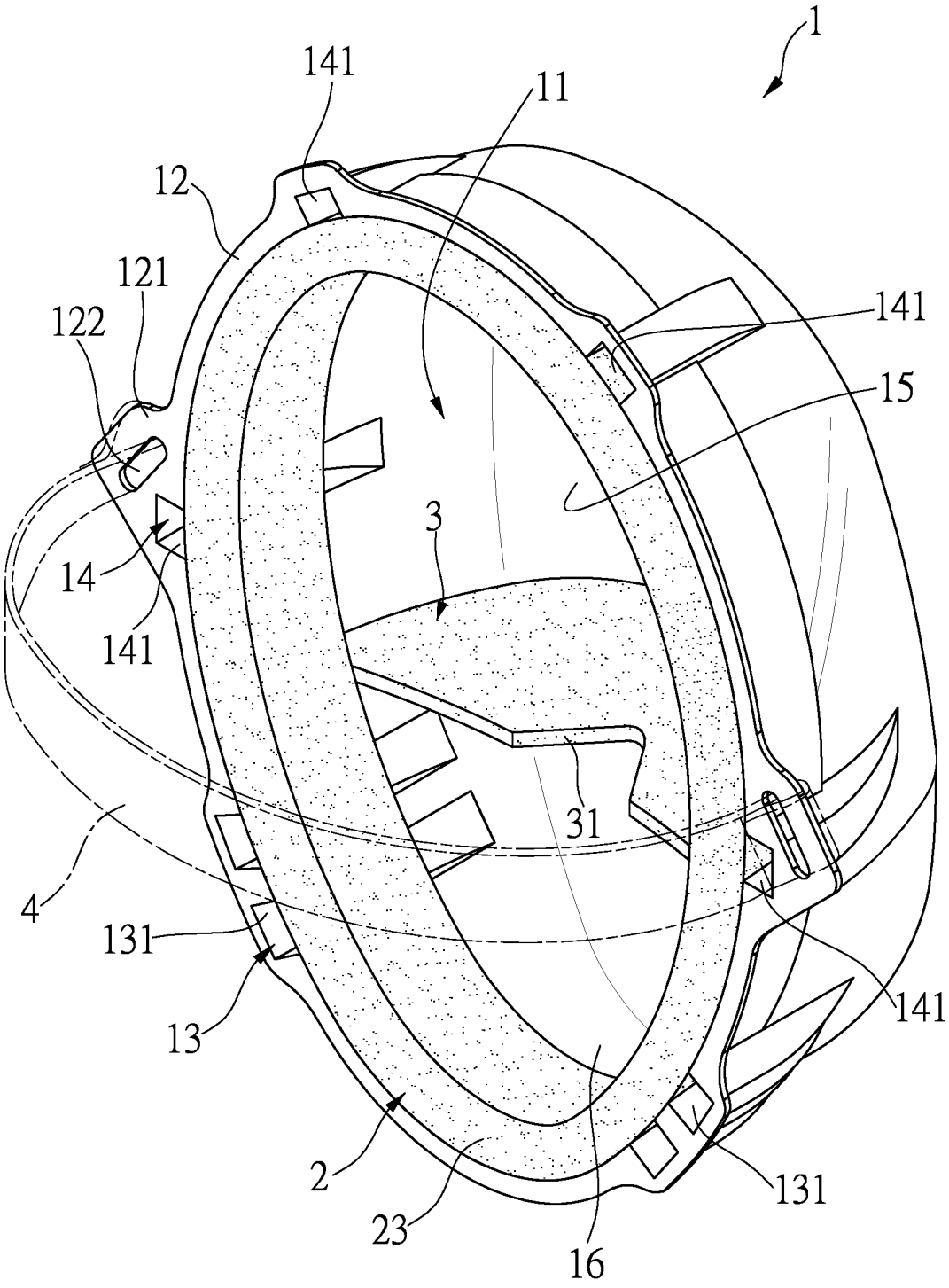
FIG. 2 is another perspective view to show the face mask of the present invention.

Referring to FIGS. 1 to 8, the face mask 1 of the present invention comprises a space 11 formed in the face mask 1 by a peripheral wall 12 extending from the periphery of the space 11. At least one first path 13 and at least one second path 14 are formed in the space 11 so that outside air enters into the space 11 via the at least one first path 13, and air in the space 11 is released from the space 11 via the at least one second path 14.

The face mask covers up the skin around the wearer's mouth, nose and eyes so as to keep the wearer's face skin from contacting the air outside the face mask. The face mask covers up a large area of the face sink, and the air between the inside of the space 11 and outside is exchanged by the first and second paths 13, 14. The air in front the user cannot touch the user's face to reduce the risk of being infected.

Figure 3:
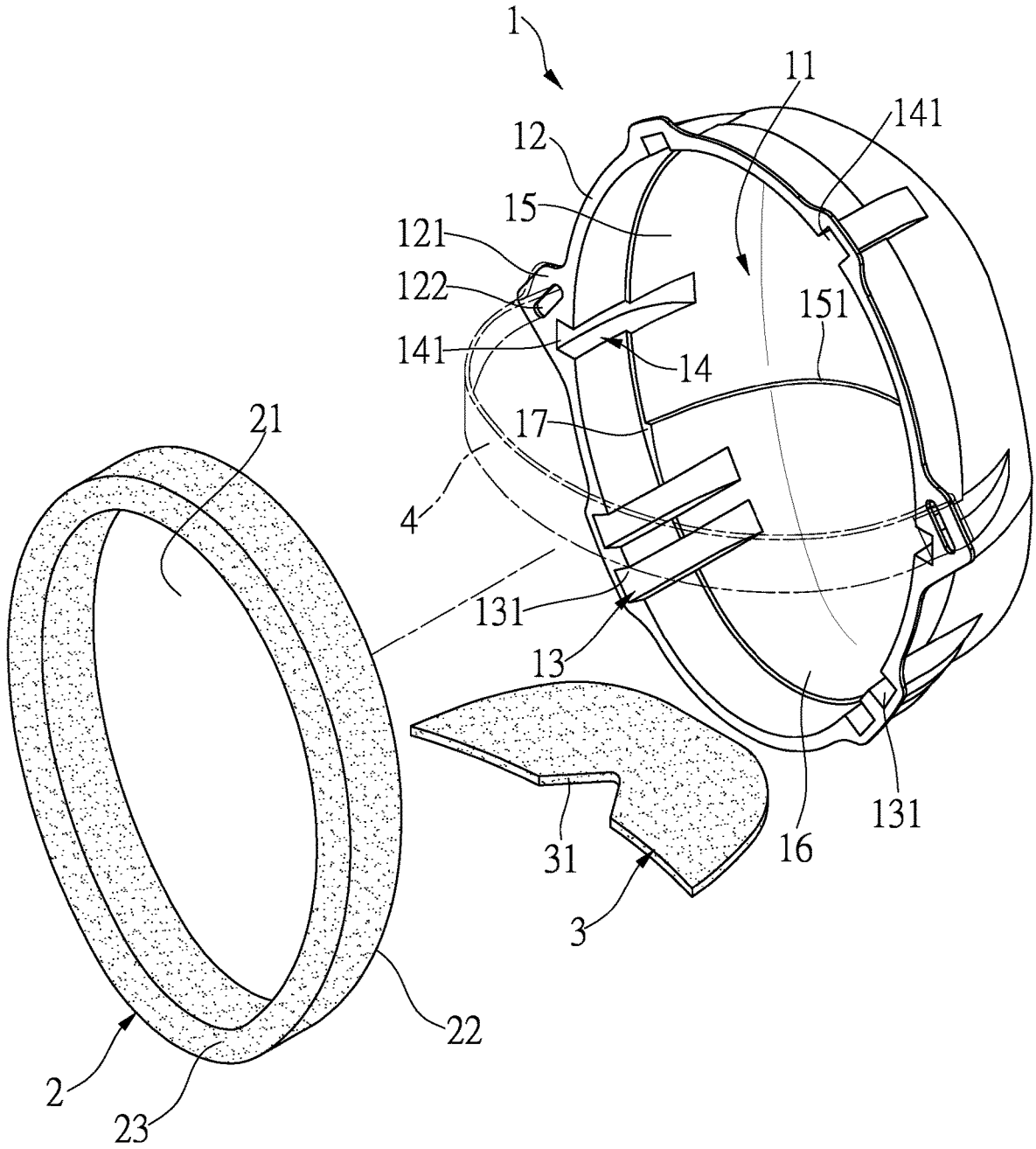
FIG. 3 is an exploded view of the face mask of the present invention.
Figure 4:
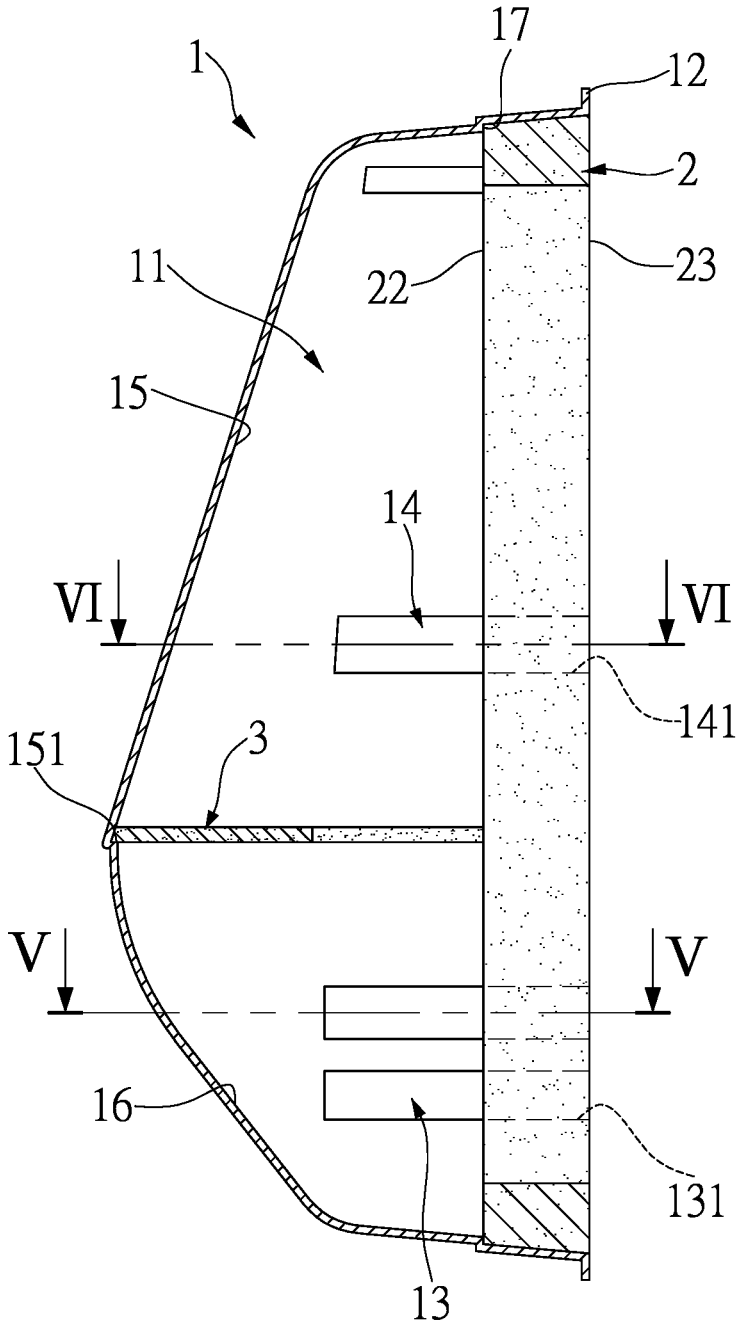
FIG. 4 is a cross sectional view, taken along line IV-IV in FIG. 1.
Figure 5:
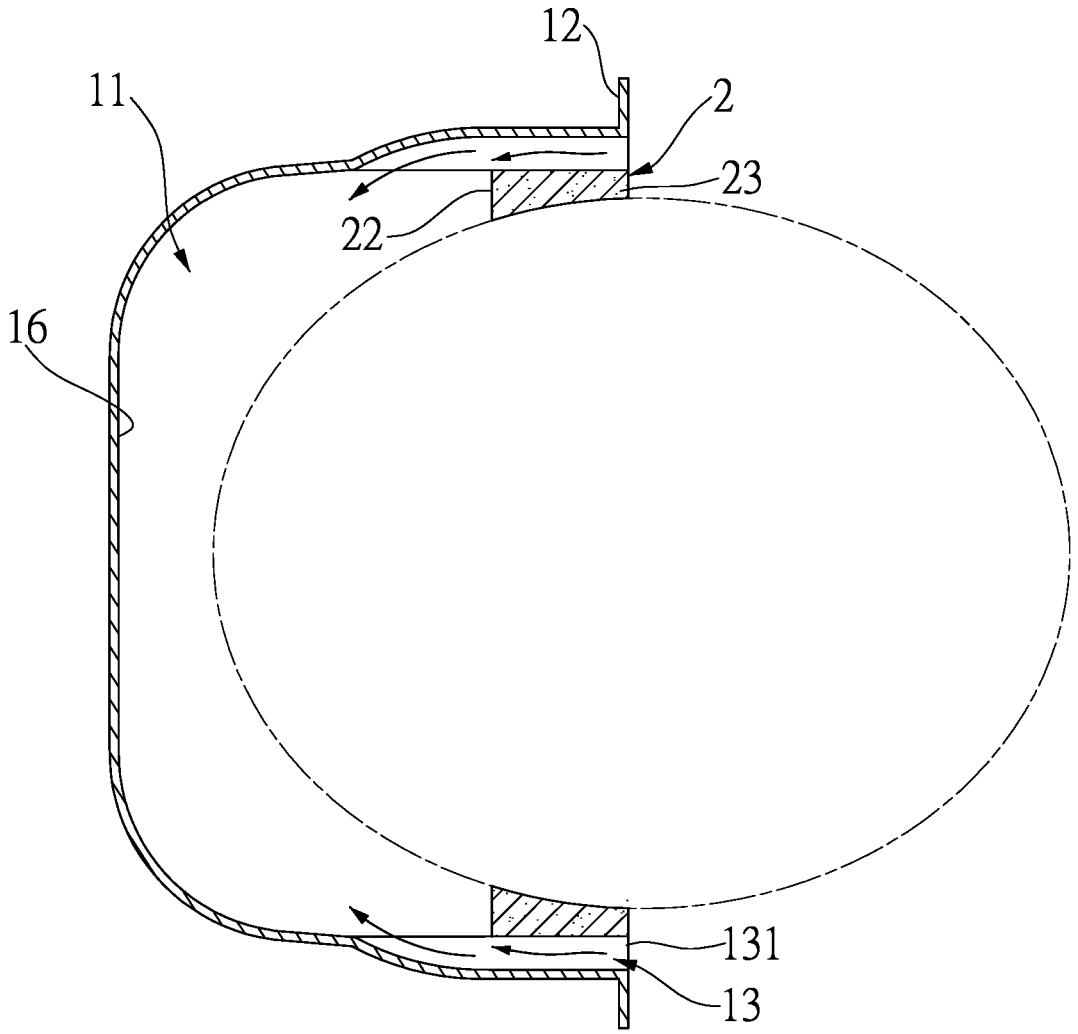
FIG. 5 is a cross sectional view, taken along line V-V in FIG. 4.
Figure 6:
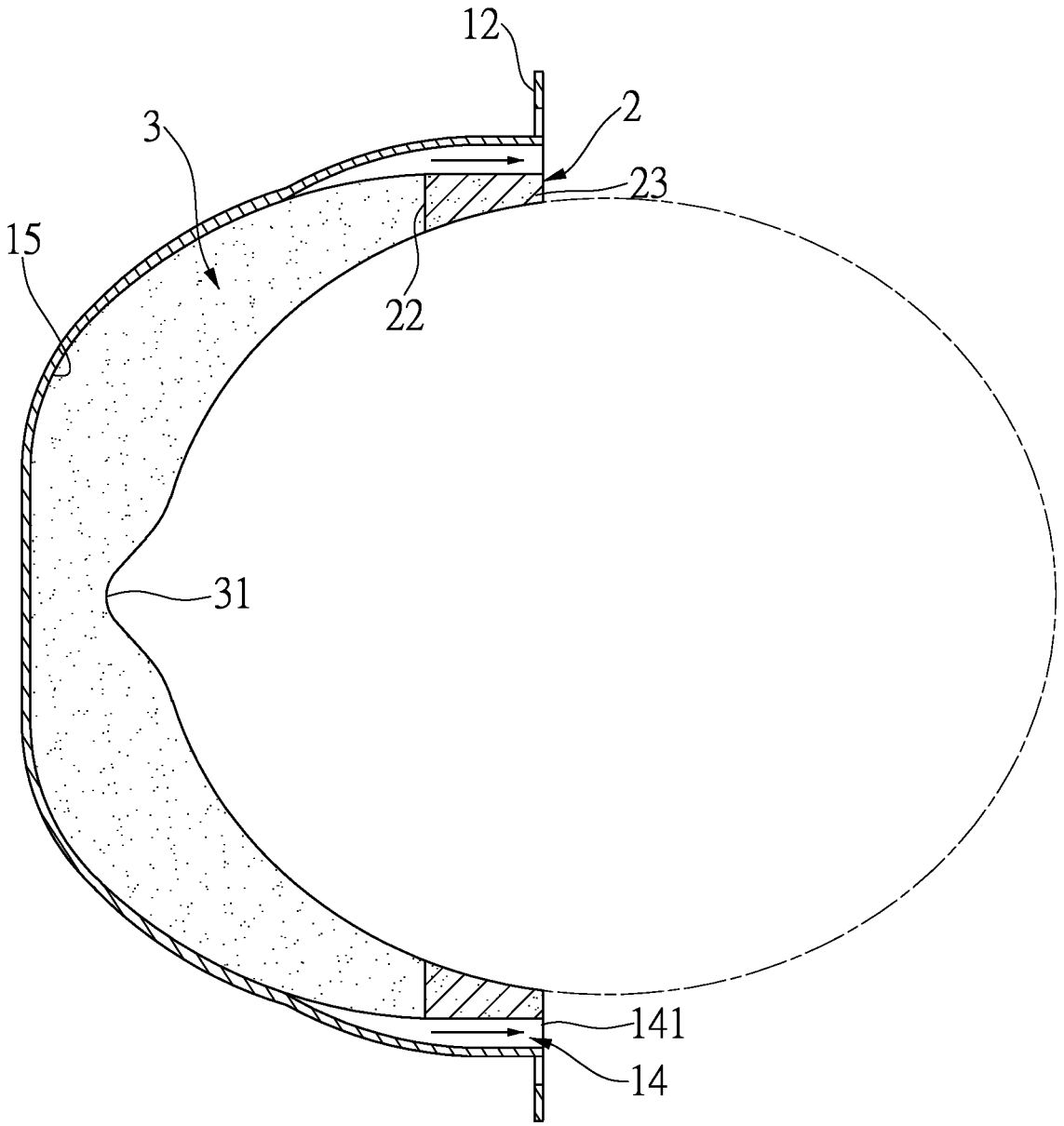
FIG. 6 is a cross sectional view, taken along line VI-VI in FIG. 4.
Figure 7:
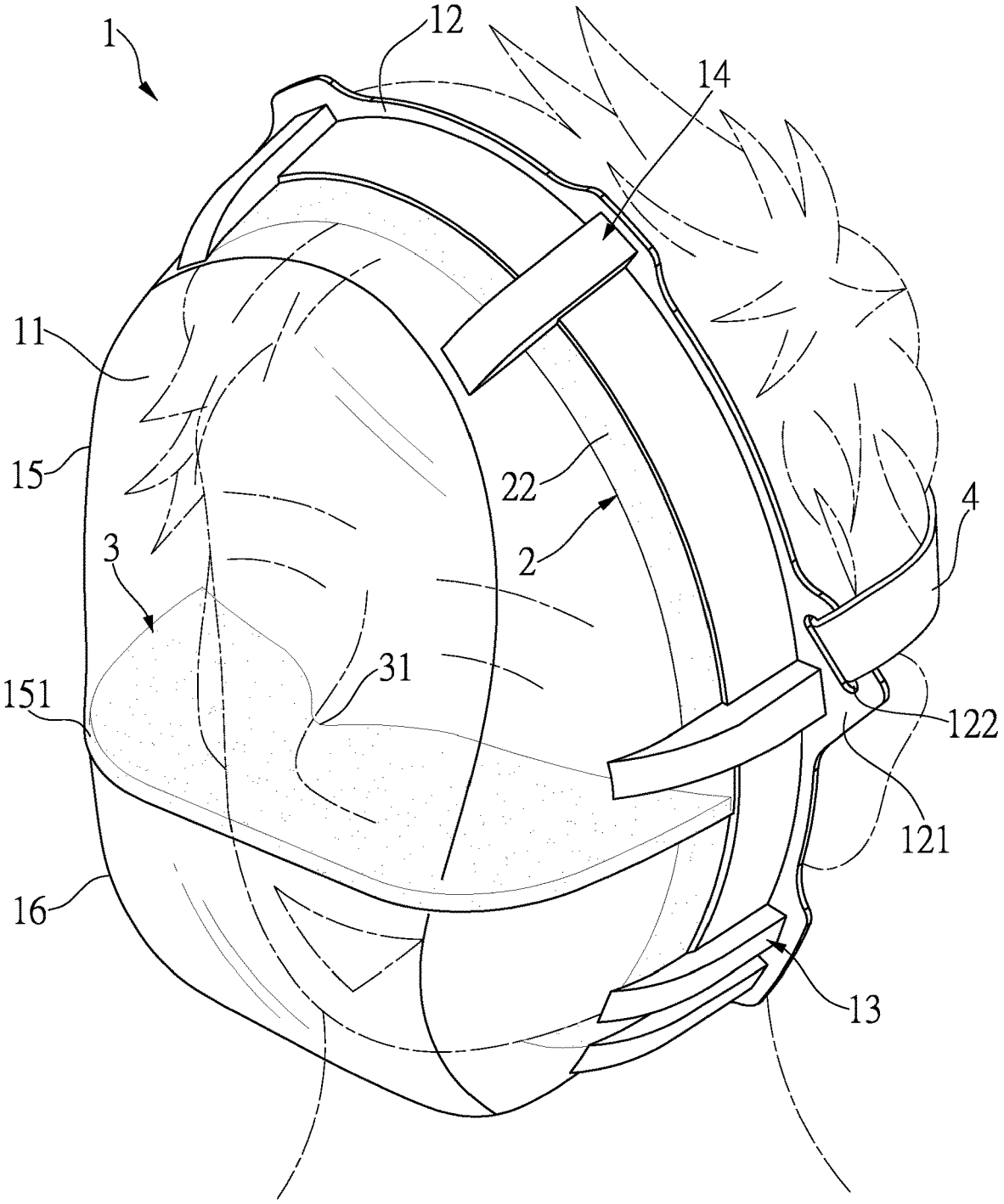
FIG. 7 illustrates that a user wears the face mask of the present invention.

As shown in FIGS. 3 to 7, a buffering member 2 is engaged with the inside of the peripheral wall 11. The buffering member 2 covers up a portion of the at least one first path 13 and a portion of the at least one second path 14. The buffering member 2 includes a hole 21 which communicates with the space 11. The user's mouth, nose and eyes are located in the space 11 via the hole 21. The buffering member 2 is made of soft material such as foam sponge to provide comfort of wearing. The buffering member 2 is a ring-shaped member and includes an engaging face 22 and a contact face 23 which is located opposite to the engaging face 22. A first shoulder 17 is formed in the periphery of the space 11. The engaging face 22 of the buffering member 2 is engaged with the first shoulder 17. As shown in FIGS. 3 and 7, the contact face 23 contacts the user's face and forms an air-tight feature. The air is exchanged via the first and second paths 13, 14 to provide fresh air into the space 11. The air flow in the first and second paths 13, 14 generally is smooth so that the air of outside the face mask 1 does not flows into the space 11. The outside air, droplets and foreign objects cannot touch the user's face.

A second shoulder 151 is formed transversely in the periphery of the space 11, and a separator 3 has a portion positioned on the second shoulder 151. The separator 3 includes a notch 31 formed opposite to the portion positioned on the second shoulder 151. The user's nose is engaged with the notch 31. The space 11 is composed an upper portion 11 and a bottom portion 16. The user's eyes and nose are located in the upper portion 15, and the mouth is located in the bottom portion 16. The separator 3 stops the moisture from the nose and mouth from spread of virus. The user can wear another mouth mask before wearing the face mask 1 of the present invention. The fresh air is provided into the space 11 to reduce accumulation of moisture from the nose and mouth.

The peripheral wall 12 includes multiple lugs 121 extending outward therefrom. Each lug 121 includes a slot 122 defined therethrough. A band 4 extends through and is positioned between the slots 122. The band 4 positions the face mask 1 to the user's head by positioning the user's head between the band 4 and the face mask 1.

Figure 8:
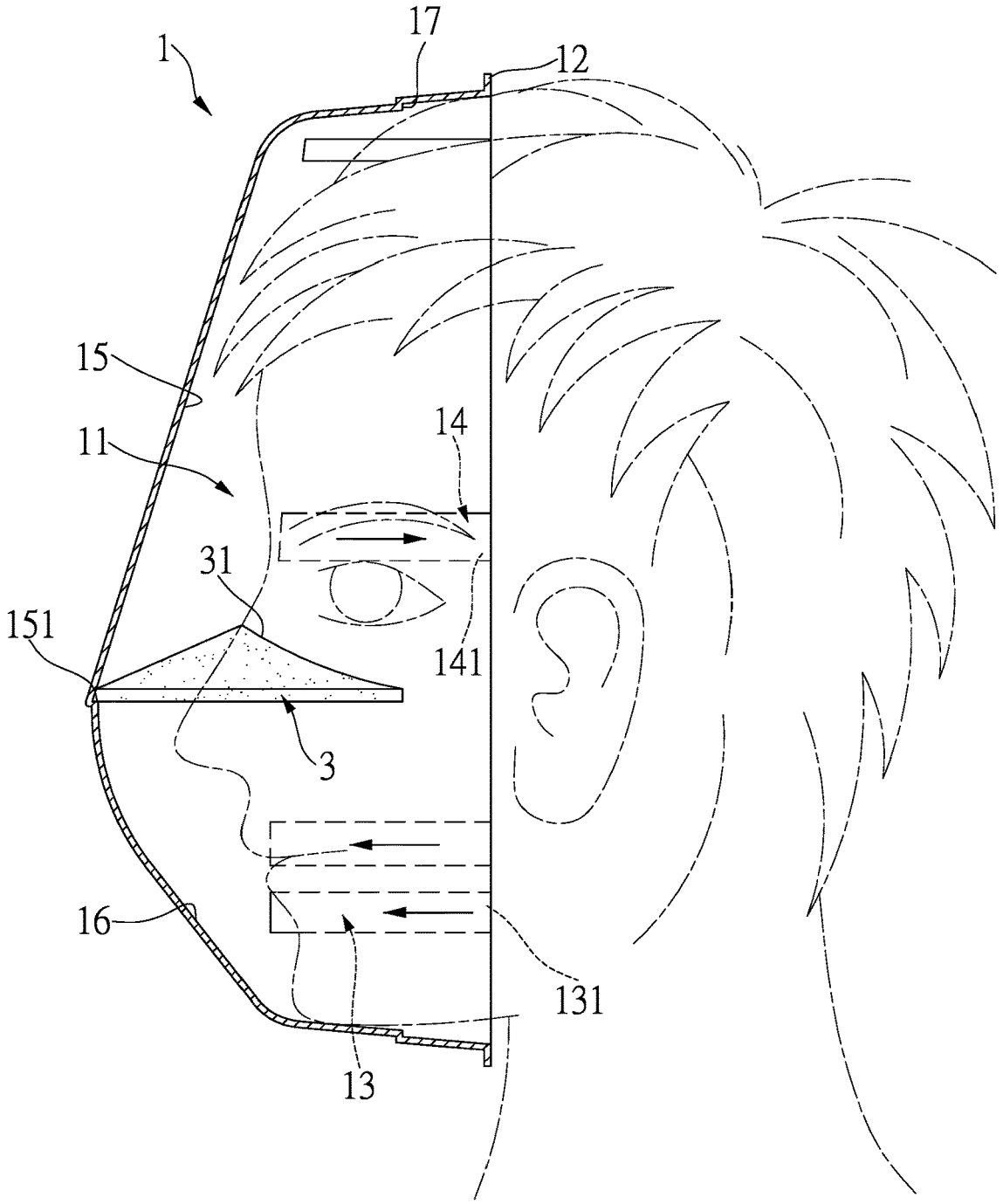
FIG. 8 is a cross sectional view to show the face mask of the present invention.

As shown in FIG. 8, the face mask 1 can also be directly put on the use's face to keep the air to touch his/her face to reduce the risk of being infected.

Figure 9:
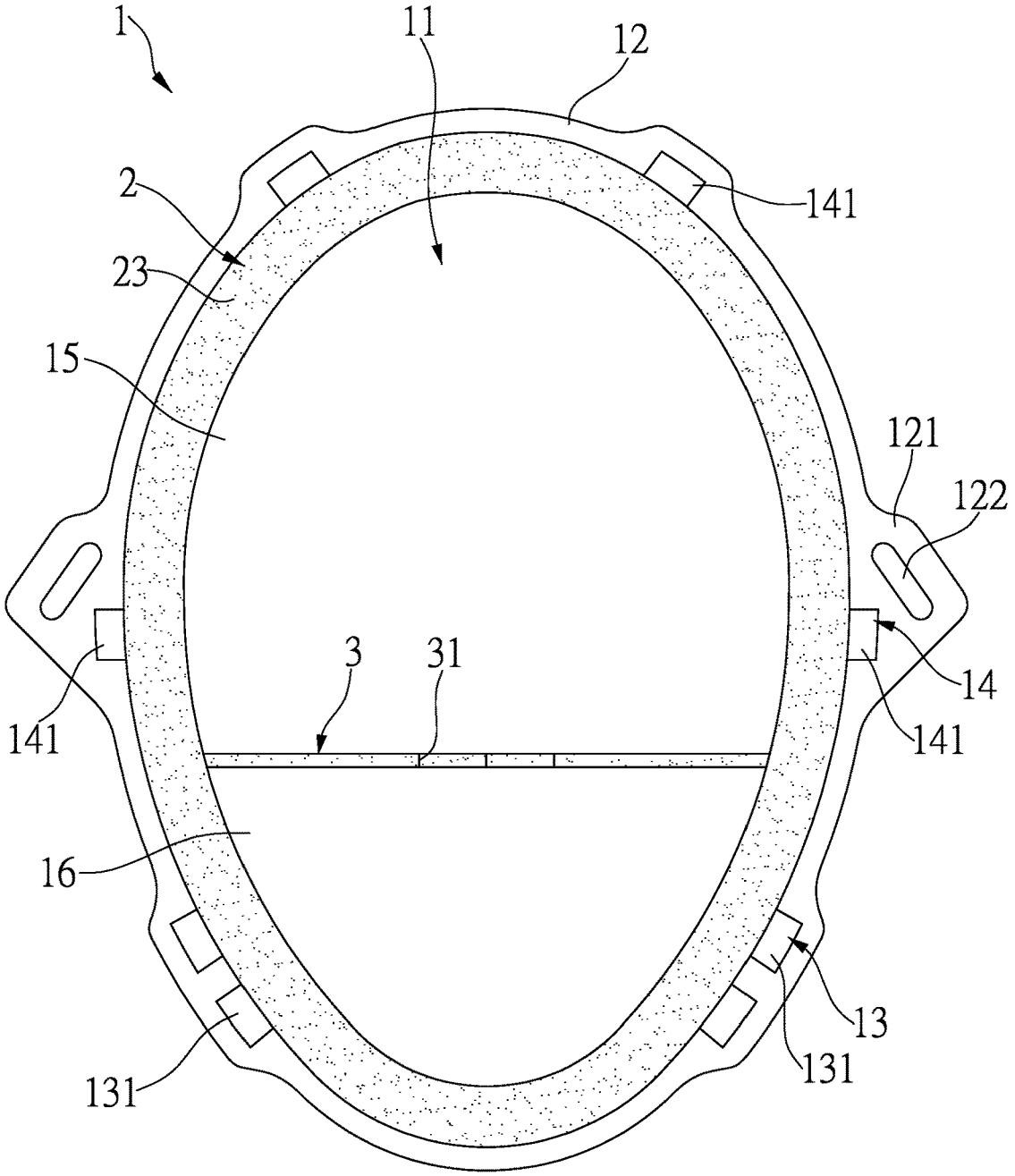
FIG. 9 is a rear side view of the face mask of the present invention.
Figure 10:
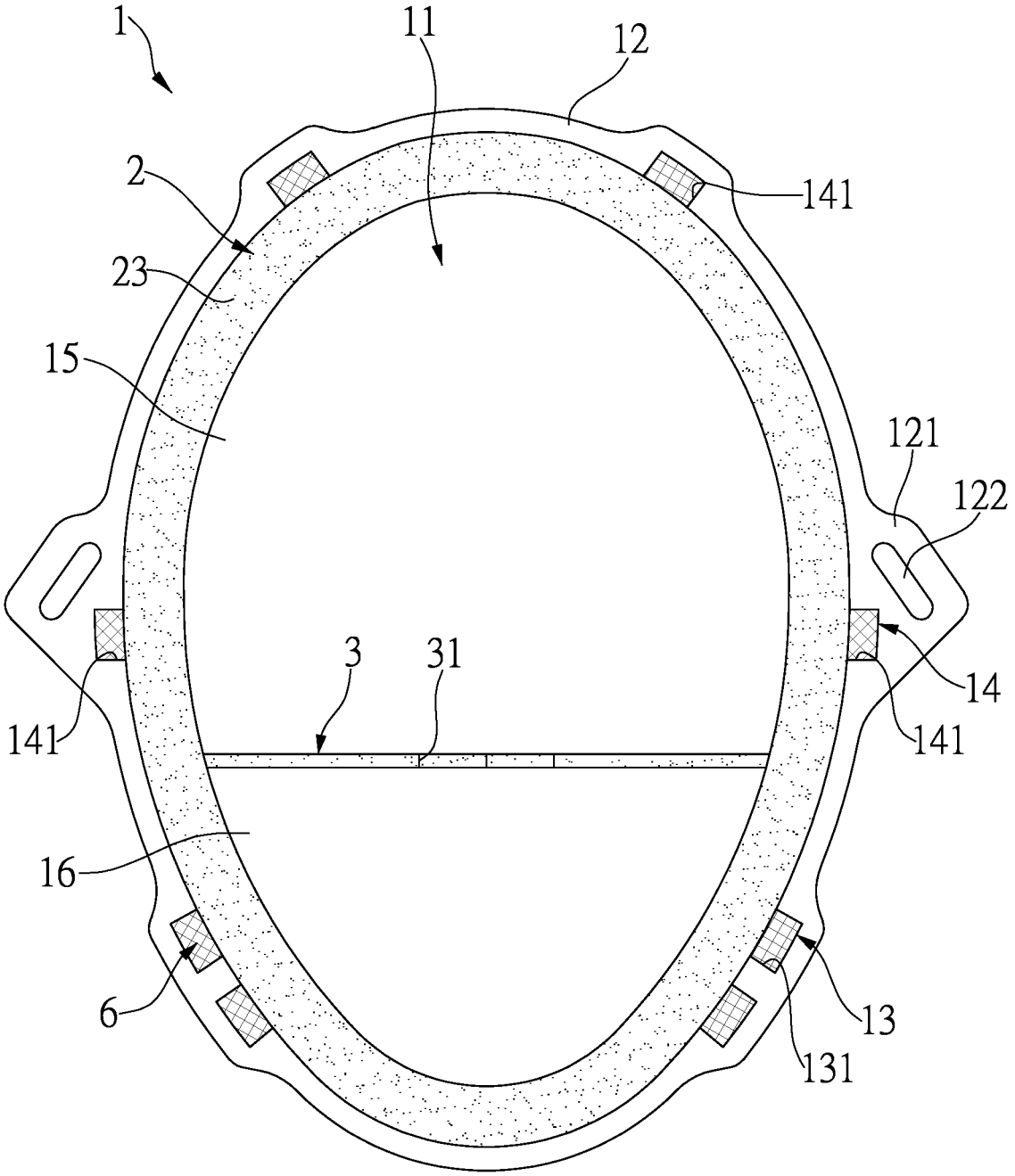
FIG. 10 shows that filters cover up the first and second paths of the face mask in FIG. 9.

As shown in FIGS. 9 to 13, the number of the second paths 14 can be vary according to practical needs. During the winter seasons, the temperature difference between the inside and outside of the face mask 1 is significant, so that the moisture can easily be accumulated in the space 11 to affect the sight of the user so that a face mask 1 with multiple second paths 14 is required as shown in FIG. 9. On the contrary, during the summer seasons, a face mask 1 with less number of the second paths 14 is needed.

Figure 11:
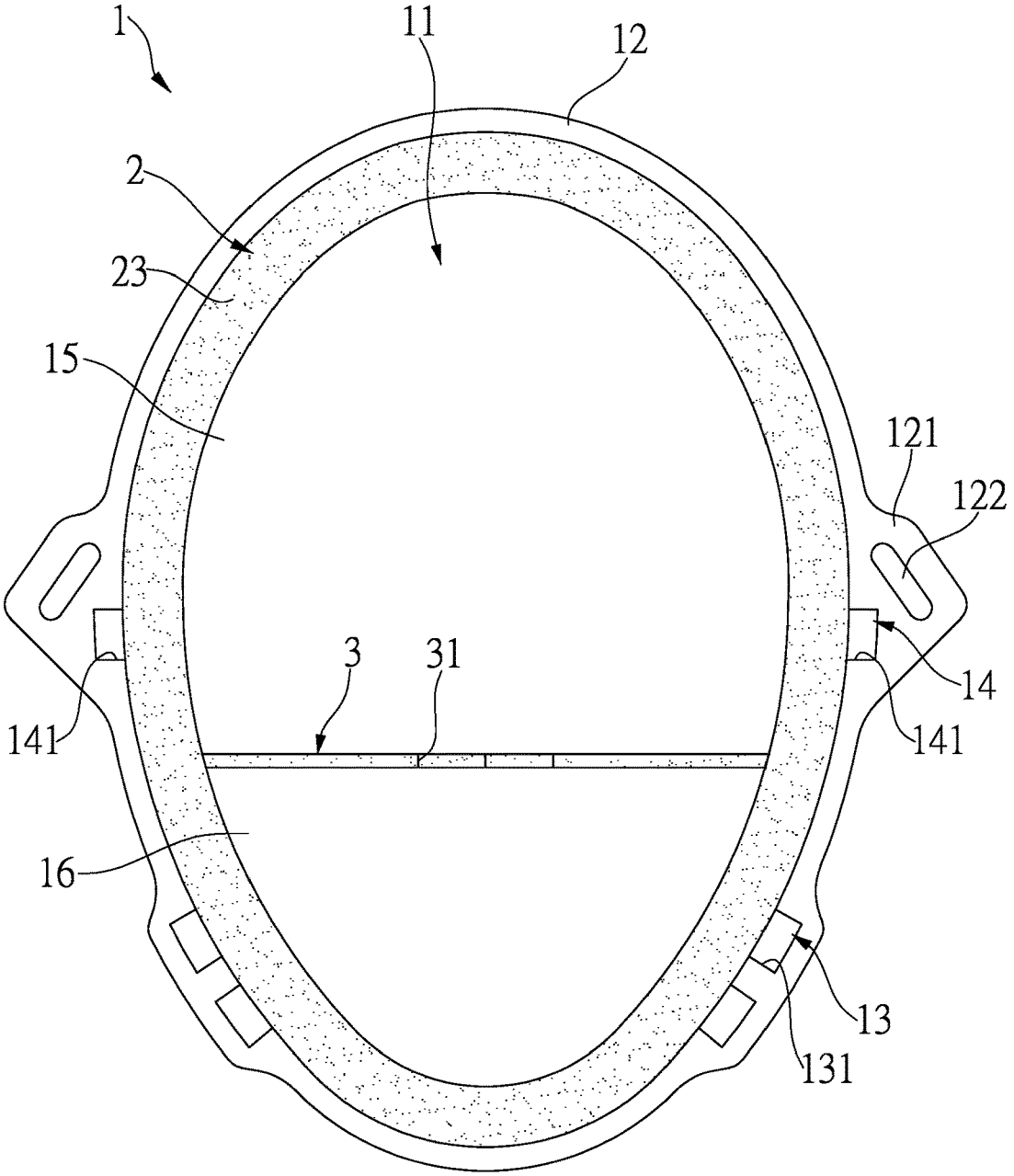
FIG. 11 is a rear side view of the face mask of the present invention.
Figure 12:
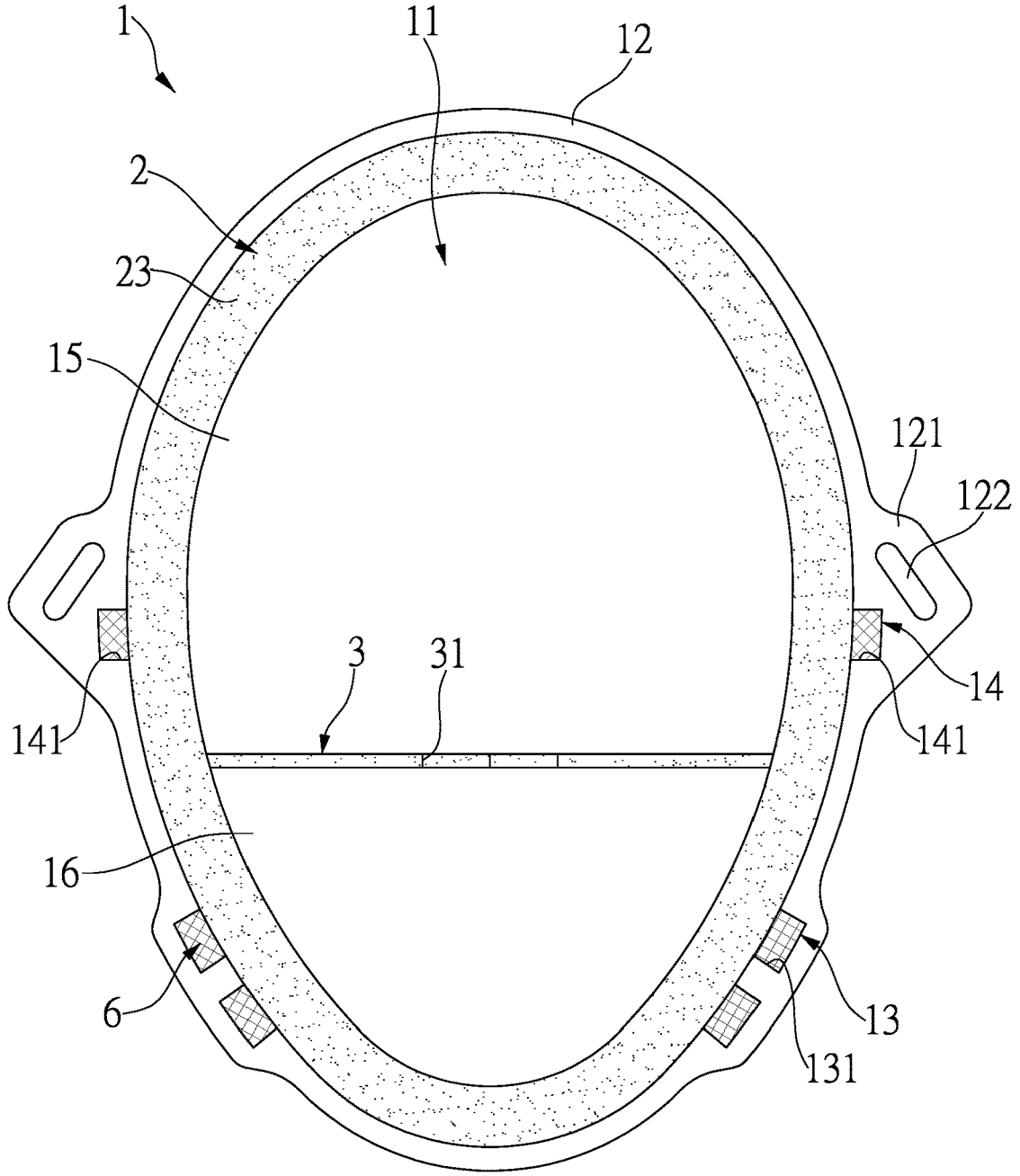
FIG. 12 shows that filters cover up the first and second paths of the face mask in FIG. 11.

As shown in FIGS. 11 and 12, each of the at least one first path 13 and the at least one second path 14 includes at least one filter 6 connected thereto. Each filter 6 covers up the at least one first path 13/the at least one second path 14 to filter toxic particles from entering into the face mask 1.

Figure 13:
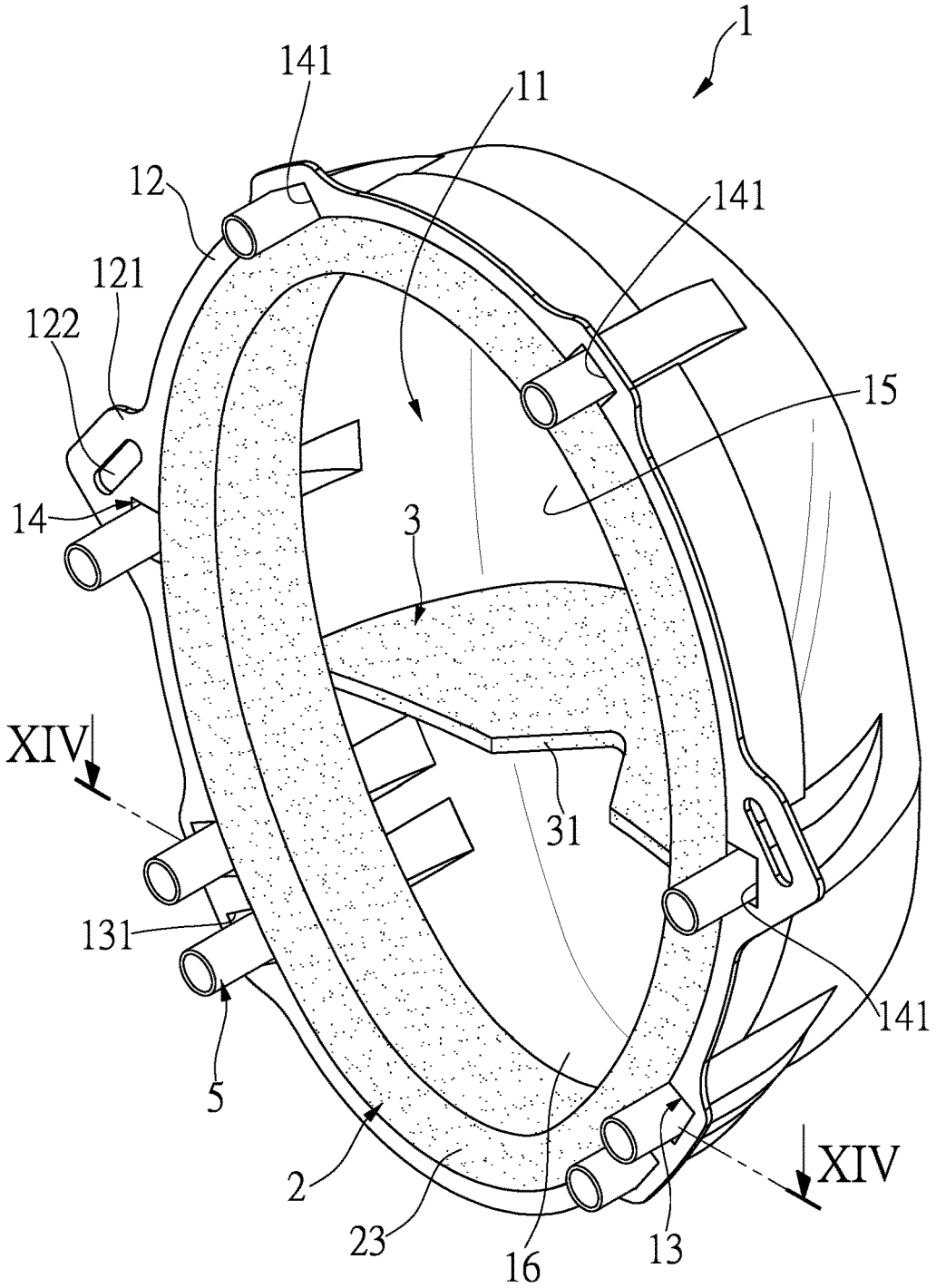
FIG. 13 shows that a hose is inserted in the first and second paths of the face mask of the present invention.
Figure 14:
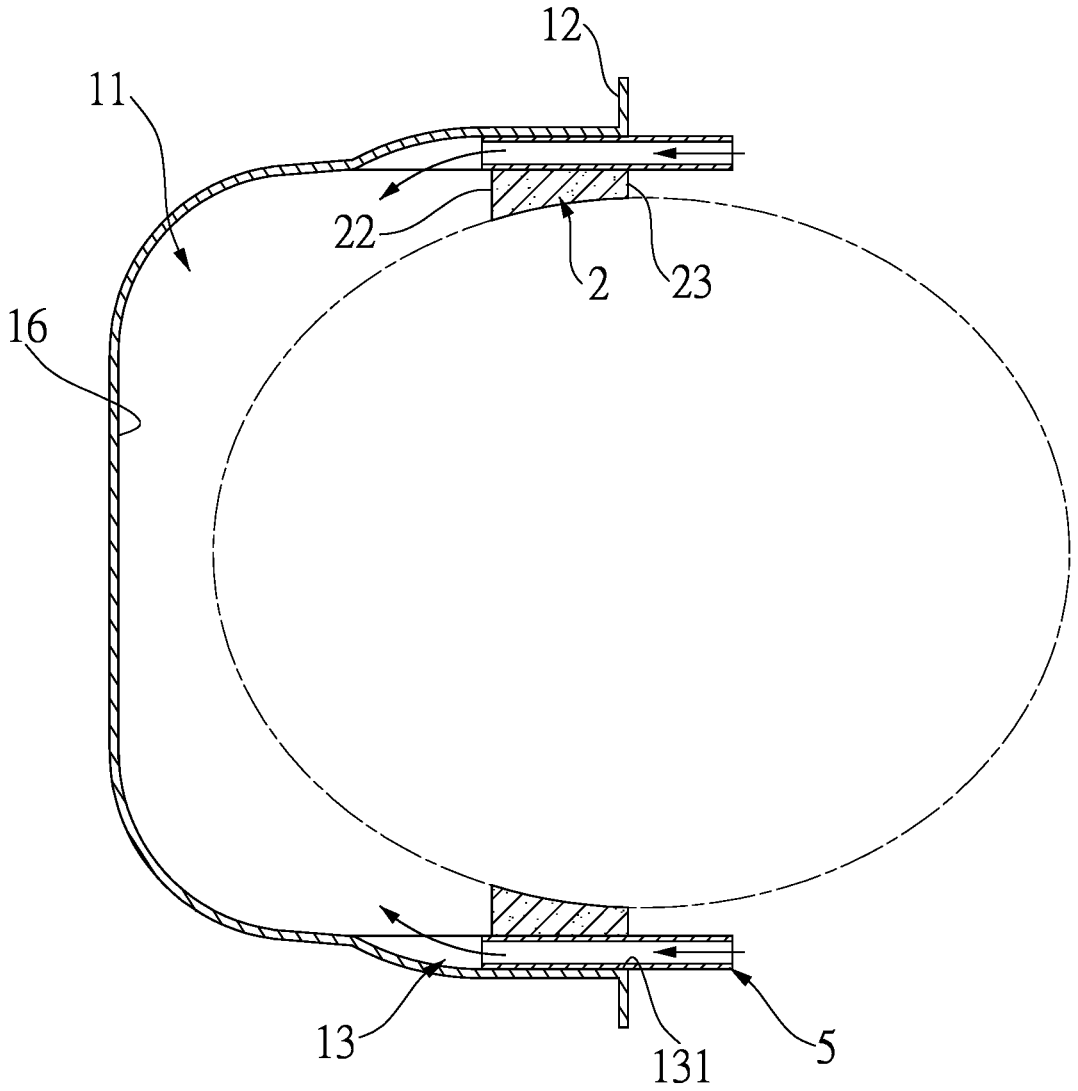
FIG. 14 is a cross sectional view, taken along line XIV-XIV in FIG. 13.

As shown in FIGS. 13 and 14, another embodiment of the face mask 1 is that a hose 5 is inserted into each of the at least one first path 13 and the at least one second path 14. Each hose 5 extends beyond the at least one first path 13/the at least one second path 14. The use of the hoses 5 increases the exchange rate of the air in the space 11.

As shown in FIG. 7, the periphery of the buffering member 2 contacts the inside of the space 11, and the separator 3 contacts the second shoulder 151, so that the face mask 1 covers up a large area of the user's face to improve the conventional face masks.

While we have shown and described the embodiment in accordance with the present invention, it should be clear to those skilled in the art that further embodiments may be made without departing from the scope of the present invention.

What is claimed is:

1. A face mask comprising:

a space formed in the face mask by a peripheral wall extending from a periphery of the space, at least one first path and at least one second path formed in the space so that outside air enters into the space via the at least one first path, and air in the space is released from the space via the at least one second path;

wherein a buffering member is engaged with an inside of the peripheral wall, the buffering member covers up a portion of the at least one first path and a portion of the at least one second path, the buffering member includes a hole which communicates with the space;

wherein the buffering member is a ring-shaped member and includes an engaging face and a contact face which is located opposite to the engaging face, a first shoulder is formed in the periphery of the space, the engaging face of the buffering member is engaged with the first shoulder; and wherein a second shoulder is formed transversely in the periphery of the space, a separator has a portion positioned on the second shoulder, the separator includes a notch formed opposite to the portion positioned on the second shoulder, the space is composed an upper portion and a bottom portion.

2. The face mask as claimed in claim 1, wherein the at least one first path includes at least one first opening formed in one end thereof, the at least one second path includes at least one second opening formed in one end thereof.

3. The face mask as claimed in claim 2, wherein a hose is inserted into each of the at least one first path and the at least one second path, each hose extends beyond the at least one first path/the at least one second path.

4. The face mask as claimed in claim 2, wherein each of the at least one first path and the at least one second path includes at least one filter connected thereto, each filter covers up the at least one first path/the at least one second path.

5. The face mask as claimed in claim 1, wherein the peripheral wall includes multiple lugs extending outward therefrom, each lug includes a slot defined therethrough, a band extends through and is positioned between the slots.

* * * * *